US005718341A

United States Patent [19]

Robertson

[11] Patent Number: 5,718,341

[45] Date of Patent: Feb. 17, 1998

[54] MERCHANDISING TRACK DEVICE HAVING BILLBOARD CLIP

[76] Inventor: James David Robertson, Mead Packaging, P.O. Box 4417, Atlanta, Ga. 30302

[21] Appl. No.: 701,618

[22] Filed: Aug. 22, 1996

[51] Int. Cl.[6] ..... A47F 1/04

[52] U.S. Cl. ..... 211/59.2; 211/74

[58] Field of Search ..... 211/59.2, 113, 211/117, 118, 208, 209, 74; 248/317, 328; 108/107, 149; 312/234

[56] References Cited

U.S. PATENT DOCUMENTS

| | | | |
|---|---|---|---|
| 1,611,036 | 12/1926 | Hovda | 211/59.2 |
| 3,831,769 | 8/1974 | Frank | 211/113 |
| 4,318,485 | 3/1982 | Clement | 211/59.2 |
| 4,367,818 | 1/1983 | Suttles | 211/59.2 |
| 4,401,221 | 8/1983 | Suttles | 211/59.2 |
| 4,556,183 | 12/1985 | Greenberger | 248/222.12 |
| 4,775,058 | 10/1988 | Yatsko | 211/184 |
| 4,830,201 | 5/1989 | Breslow | 211/184 |
| 5,042,768 | 8/1991 | Goldstein | 248/223.41 |
| 5,586,687 | 12/1996 | Spanner et al. | 211/59.2 |

FOREIGN PATENT DOCUMENTS

| | | |
|---|---|---|
| 2 647 328 | 11/1990 | France . |
| WO 96/25074 | 8/1996 | WIPO . |

*Primary Examiner*—Peter M. Cuomo
*Assistant Examiner*—Gerard A. Anderson
*Attorney, Agent, or Firm*—Tsugihiko Suzuki

[57] ABSTRACT

A merchandising device comprises first and second elongate parallel tracks arranged side by side with a gap therebetween, and a bridging member disposed near the front ends of the tracks. Each track is designed to support a row of articles in such a manner that the articles are suspended from each track for movement along a path defined by that track and are removable from that track through its front end. The gap between the tracks are spanned by the bridging member to provide a billboard surface extending between the tracks.

13 Claims, 2 Drawing Sheets

MERCHANDISING TRACK DEVICE HAVING BILLBOARD CLIP

BACKGROUND OF THE INVENTION

This invention relates to merchandising devices for articles such as soft drink bottles, and particularly to a suspension-type display device in which articles are suspended from a plurality of spaced parallel tracks.

Suspension-type display devices have been used in the merchandising of soft drink bottles such as PET bottles having outwardly projecting annular neck flanges. These devices have a plurality of elongate tracks supported on a rack wherein the tracks are arranged side by side in a spaced parallel relationship. Each track has a pair of parallel rails extending along that track. The necks of flanged bottles are received between the rails of each track so that the bottles are engaged at their neck flanges with the rails and thus suspended from the respective track. The bottles received in each track are automatically arranged in a tidy row along the respective track and presented for removal by customers through the front end of the respective track. The distance between adjacent tracks are great enough to prevent interference between the bottles suspended from the adjacent tracks. To assure such a distance, it is typical that a certain gap or space is defined between adjacent tracks.

Conventional merchandising devices of the type described above are disclosed, for example, in U.S. Pat. Nos. 4,318,485; 4,367,818; and 4,401,221 which are owned by the assignee of the present invention and in French Published Application 2,647,328.

SUMMARY OF THE INVENTION

The present invention provides a merchandising device which comprises first and second elongate parallel tracks arranged side by side with a gap therebetween, and a bridging member disposed near the front ends of the tracks. Each track is designed to support a row of articles in such a manner that the articles are suspended from each track for movement along a path defined by that track and are removable from that track through its front end. The gap between the tracks are spanned by the bridging member to provide a billboard surface extending between the tracks.

According to a preferred embodiment of the invention, the bridging member is interposed between and in abutment on the tracks to maintain a predetermined distance between the tracks.

According to another preferred embodiment, the bridging member is removably connected to both the tracks.

According to a further preferred embodiment, each track comprises a pair of side walls interconnected by a top wall, and an end flange formed at the front end of that track. The end flange of each track has portions extending outwardly from the associated side walls. The end flanges of the tracks are interconnected by the bridging member. In this embodiment the bridging member may be of a one-piece structure formed of resilient material and may comprise first engaging means for hooking over one of the upper and lower edges of the each end flange, and second engaging means for snap engagement with the other edge of each end flange. The bridging member may further comprise a flat body. The first and second engaging means may be formed on the rear side and may be positioned in an opposing relationship. The first engaging means may be a first hook extending from the rear side of the flat body and may be turned toward the second engaging means whereas the second engaging means may be a second hook extending from the rear side generally toward the first engaging means and curved away from the first engaging means.

In a further preferred embodiment, the device further comprises support means for supporting the tracks in a side-by-side disposition. The support means comprises a pair of front and rear transverse support members disposed generally perpendicularly to the tracks. Each track comprises first means for mounting each track on the front transverse member for movement along the front transverse member, and second means for mounting each track on the rear transverse member for movement along the rear transverse member. The device further comprises means for preventing the tracks from movement along the transverse members, which preventing means comprises the bridging member.

DETAILED DESCRIPTION OF THE PREFERRED EMBODIMENT

Figure 1:
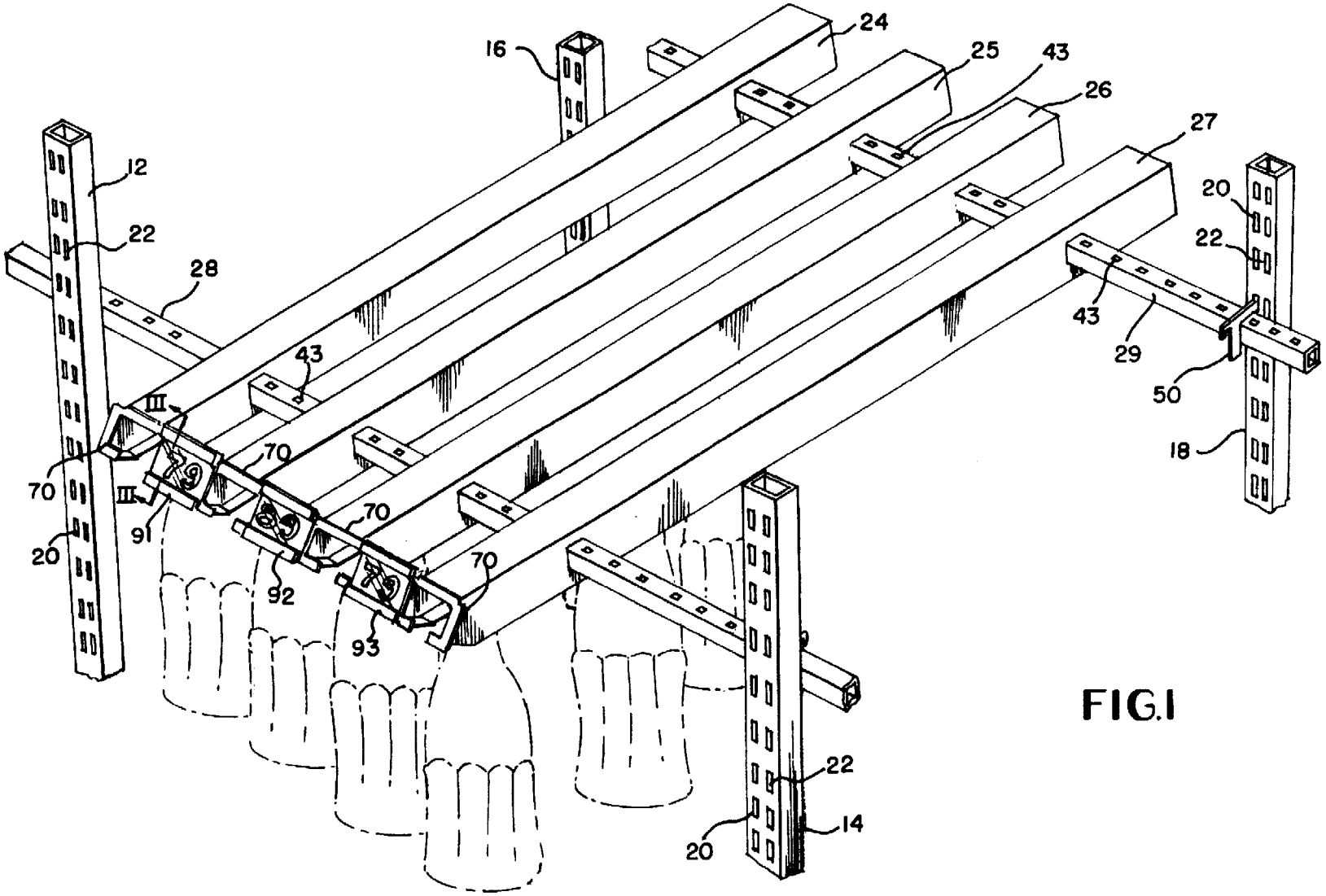
FIG. 1 is a perspective view of a suspension-type display device according to the present invention.
Figure 2:
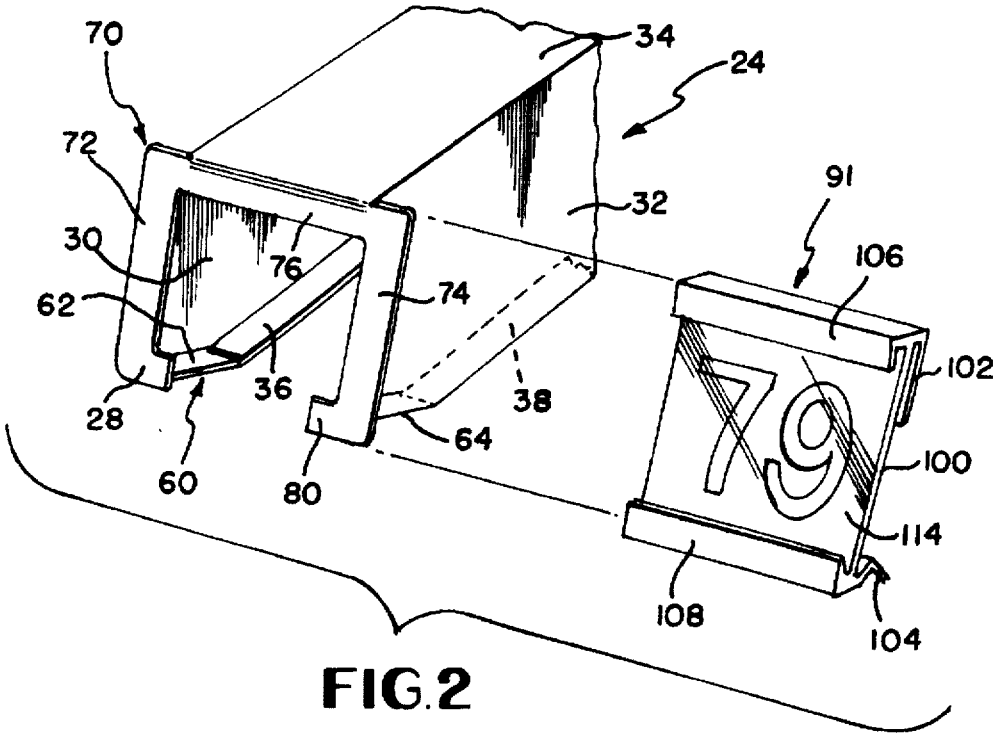
FIG. 2 is an enlarged fragmentary perspective view of one of the tracks in FIG. 1, showing an associated bridging member dismounted therefrom.
Figure 3:
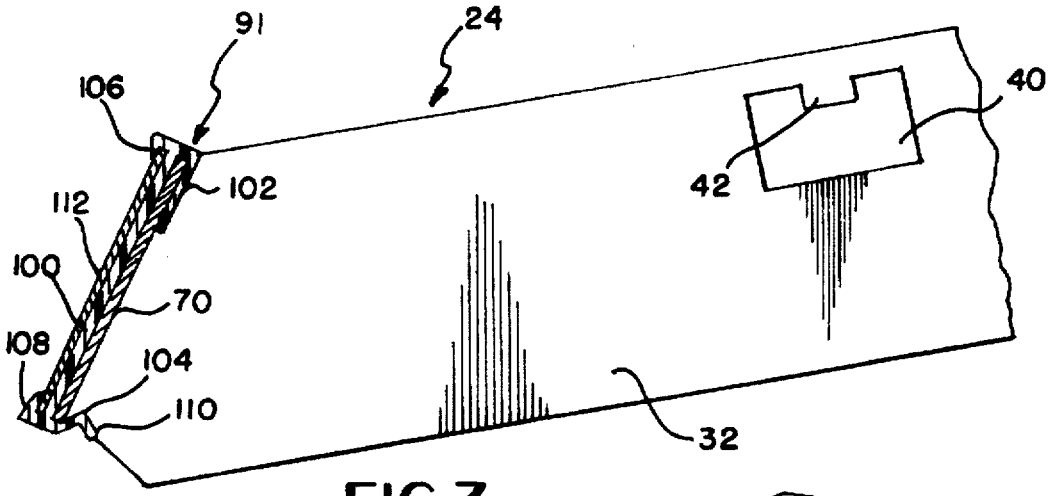
FIG. 3 is a fragmentary view taken along the Line III—III in FIG. 1 with the front transverse member being omitted.

FIGS. 1–3 illustrate a merchandising device according to this invention. The device includes one or more bottle dispenser units of the kind shown in FIG. 1 removably mounted on a rack. The rack may be a conventional four-post rack as partially shown in FIG. 1. Alternatively, the rack may be composed of a base having a vertically extending back wall on which unit-supporting arms are cantilevered. The device may have only one dispenser unit; however, it will in general have two or more dispenser units arranged one above another.

The dispenser unit in FIG. 1 is designed for use preferably on a four-post rack having four upright corner posts, i.e., a pair of front posts 12 and 14 and a pair of rear posts 16 and 18, connected together by horizontal members (not shown) of a suitable number. The four corner posts 12, 14, 16 and 18 are of substantially the same structure having a number of engaging openings arranged vertically along the side wall of the respective corner post. In FIG. 1, each post is shown as having two vertical rows of openings 20 and 22. However, one vertical row of openings in each corner post may be sufficient in most of the cases wherein the post is used as a vertical support for the dispenser units.

The dispenser unit in FIG. 1 has a plurality of spaced parallel tracks 24, 25, 26 and 27 having their front ends disposed between the front posts 12 and 14 and extending backward from the front ends. The tracks 24–27 are interconnected through a pair of front and rear transverse support members 28 and 29 extending perpendicularly to the tracks 24–27. The tracks 24–27 are virtually identical to each other, and so are the front and rear transverse members 28 and 29. Accordingly, the details will hereinafter be described regarding only the track 24 and the transverse member 28. Those portions of the tracks 25–27 identical to the track 24 are identified by the same reference numerals, and those of the member 29 identical to the member 28 are denoted by the same reference numerals.

The track 24 is formed preferably of a metal plate or a molded plastic. As best illustrated in FIG. 2, the track 24 has a pair of longitudinally extending opposed side walls 30 and 32 joined together along their upper edges by a top wall 34. The side walls 30 and 32 and the top wall 34 in cooperation form a channel structure having an inverted U-shaped cross section. A pair of parallel rails 36 and 38 are joined respectively along the lower edges of the side walls 30 and 32 so as to project inwardly of the track 24. A space is maintained between the rails 36 and 38 to receive therein the necks of flanged bottles. The distance between the rails 36 and 38 is such that when bottle necks are received between the rails 36 and 38, the bottles are automatically arranged in a row and the undersides of the neck flanges engage the rails 36 and 38 to allow the bottles to be suspended for sliding movement along the track 24. When the track 24 is supported to incline to its front end, the suspended bottles gravity feed one after another to the front end of the track 24 as the leading bottles on the track successively are removed from the track through the front end.

Typical flanged bottles used with the device of the invention may be soft drink bottles formed of plastic such as PET and having integrally formed outwardly projecting annular flanges at their necks immediately under their caps. The bottles suspended by their neck flanges are shown in dotted lines in FIG. 1. The detailed manner in which the bottles are suspended by their neck flanges is described in U.S. patent application Ser. No. 08/389,379, owned by the assignee of the present application, which is hereby incorporated by reference.

As also shown in FIG. 2, the track 24 is provided with a stopper 60 at its front end. The stopper 60 comprises a length of the track 24 adjacent to its front end. Such a length is upturned relative to the immediately preceding length of the track 24 to provide forwardly upturned portions 62 and 64 of the rails 36 and 38. When the leading bottles in the track 24 travel along the upturned portions 62 and 64, they are braked to a stop and presented for removal from the track 24. The upturned length of the track 24 may be formed integrally with the track 24 or it may be provided as a separate replaceable portion.

As further shown in FIG. 2, the track 24 is also provided at the front end with a generally C-shaped end flange 70 which is designed to increase the rigidity of the front end. The end flange 70 includes a pair of opposed side portions 72 and 74 formed respectively along the sloping forward edges of the side walls 30 and 32 of the track 24. The side portions 72 and 74 extend outwardly from the side walls 30 and 32. These side portions 72 and 74 are interconnected by a top portion 76 which is formed along the forward edge of the top wall 34 and extending downwardly and inwardly therefrom. The end flange 70 terminates with inwardly turned ends 78 and 80 which constitute the forward ends of the upturned portions 62 and 64. These ends 78 and 80 are greater in thickness than the remainder of the rails 36 and 38 and thereby prevent the rails 36 and 38 from being mistakenly received between the cap and the flange of a bottle.

The side walls 30 and 32 of the track 24 are provided at near each track end with a pair of opposed generally rectangular apertures 40 (only one shown in FIG. 3). The apertures 40 near the front end of the track 24 are identical in size and receive the front transverse member 28 so that the front end portion of the track 24 is supported by the member 28. The size of the front end apertures 40 is such that the apertures 40 allow the track 24 to slide along the member 28. The apertures 40 near the rear end of the track 24 are of the same size and receive the rear transverse member 29 so that the rear end portion of the track 24 is supported by the member 29. The rear end apertures 40 also allow the track 24 to slide along the member 29.

As shown in FIG. 3, a tab 42 projects downwardly from the perimeter of each of the front and rear end apertures 40. These tabs 42 are provided to be received in recesses or openings 43 (shown in FIG. 1) in the transverse members 28 and 29 to lock the track 24 in a selected position on the members 28 and 29.

The front transverse member 28 is of a rectangular tube structure formed of metal or plastic. It is extended between the front corner posts 12 and 14 while passing transversely through all the tracks 24–27 in the dispenser unit as shown in FIG. 1. The opposite ends of the member 28 are detachably mounted on the front corner posts 12 and 14 by means of suitable brackets.

The rear transverse member 29 is extended between the rear corner posts 16 and 18 while passing through the tracks 24–27. The opposite ends of the member 29 are detachably mounted on the rear corner posts 16 and 18 by means of suitable brackets.

The brackets for mounting the members 28 and 29 on the respective posts may be those having a first portion for engagement with the associated end of the respective transverse member and a second portion for insertion into one of the openings of the associated front corner post. A typical example of such a bracket includes a T-hook, a S-hook or the like. FIG. 1 shows a T-hook 50 loosely engaged with each end of the transverse members so as to be a built-in part of the dispenser unit. Alternatively, the brackets may be front and rear joints described in U.S. patent application Ser. No. 08/684,357 owned by the assignee of the present application, which is hereby incorporated by reference.

The slots 20 and 22 of the posts 12, 14, 16 and 18 with which the brackets are engaged are selected such that each of the front and rear transverse members 28 and 29 is held substantially horizontally while the rear member 29 is supported at the position higher than the front member 28. Such an arrangement permits the tracks 24–27 to be inclined downwardly toward their respective front ends. The inclination of the tracks 24–27 allows the bottles on the tracks to gravity feed to the front ends as the leading bottles on each track are removed successively from that track.

As shown in FIG. 1, bridging clips 91–93 are positioned among the tracks 24–27. Each clip is of a one-piece structure formed of resilient material such as metal or plastic, and includes a panel-like flat body 100, first and second hooks 102 and 104, and first and second opposing lipped flanges 106 and 108 (shown in FIGS. 2 and 3). The first hook 102 is formed along the upper edge of the flat body 100. It extends from the rear side of the flat body 100 and is turned downwardly toward the second hook 104 which is formed along the lower edge of the flat body 100. The second hook 104 extends upwardly and backwardly from the rear side of the flat body 100 and then curved or turned downwardly to provide a sloping guide edge 110. The lipped flanges 106 and 108 are formed respectively along the upper and lower edges of the flat body 100 and extend from the front side of the flat body 100. These flanges 106 and 108 define channels for slidably receiving the upper and lower edges of a printed card 112 (shown in FIG. 3) that carries information such as an advertisement, a trademark, a price of the displayed product or the like. The clip, however, may carry another type of information media such as a sticker or a coating. In FIG. 2, for example, shows a price sticker or tape 114 attached to the front side of the clip 91.

Each clip is mounted between the front ends of adjacent tracks in such a manner that the end flanges 70 of the adjacent tracks are interconnected by that clip. More specifically, the clip 91 is located between the tracks 24 and 25 to span the gap between the end flanges 70 of the tracks 24 and 25 and to thereby provide a billboard surface extending between the tracks 24 and 25. This is achieved, for example, by hooking the first hook 102 over both the upper edges of the end flanges 70 of the adjacent tracks 24 and 25 and pressing the second hook 104 against the lower edges of the same end flanges 70. By this means, the first hook 102 envelops the upper edges of the adjacent flanges 70 whereas the second hook 104 snaps into engagement with the lower edges of the flanges 70, which is best shown in FIG. 3. The other clips 92 and 93 are mounted on their associated tracks to provide billboard surfaces at the front ends of the tracks 25–27.

Each clip is preferably of the size such that the opposite side edges of at least one of the hooks 102 and 104 are in abutment on the adjacent side walls of the associated tracks. This arrangement allows each clip to function as a spacer for maintaining the gap between the associated tracks. To maintain a proper gap or distance between adjacent tracks is important for the track device. More particularly, larger diameter bottles such as 1-liter bottles require a greater track distance than do smaller diameter bottles such as 20-oz bottles to avoid interference between the bottles on adjacent tracks. On the other hand, it is preferred that the track distance for smaller diameter bottles be adjusted to a smaller dimension than that for larger diameter bottles to utilize the floor space as efficiently as possible.

According to the invention, the track distance can be adjusted easily by dismounting the clips 91–93 from the tracks 24–27 and sliding the tracks along the transverse members 28 and 29. The tabs 42 of the tracks are also disengaged from the members 28 and 29 to allow the tracks to slide along the members 28 and 29. Dismounting of the clips can be achieved easily by pulling the second hook 104 of each clip forwardly to snap it disengaged from the lower edges of the associated tracks. After adjusting the track distance, different bridging clips of the size suitable for the adjusted track distance are mounted on the tracks.

Figure 4:
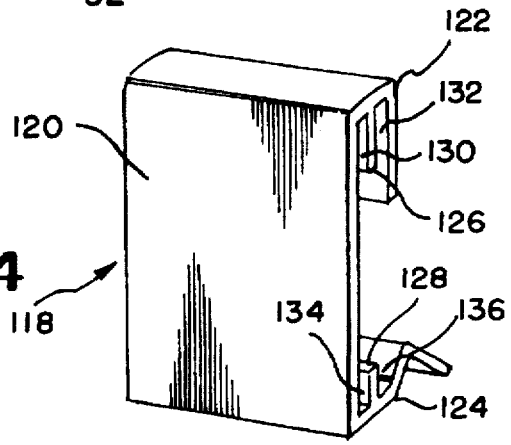
FIG. 4 is a perspective view of modified form of the bridging member in FIG. 1.

It will be recognized that many variations may be made to the foregoing within the scope of the present invention. For example, the clips 91–93 may be mounted on the tracks in an inverted condition. More specifically, the first hook 102 of each clip may be hooked on the lower edges of the end flanges of the associated tracks to allow the second hook 104 to snap engaged with the upper edges of the end flanges. The design of the bridging clips in the invention may also be varied. For example, clips having no hook but with a layer of adhesive on the rear side may be used instead of the clips 91–93. Alternatively, clips as shown in FIG. 4 may be used. The clip 118 in FIG. 4 does not have the lipped flanges on the front side. However, it has upper and lower partitions 126 and 128 formed on the first and second hooks 122 and 124. The first partition 126 extends downwardly from the first hook 122 and is interposed between the flat body 120 and the downturned portion of the first hook 122. This defines a first channel 130 for slidably receiving the upper edge of a printed information card as well as a second channel 132 for receiving one of the upper and lower edges of the associated track end flanges. The second partition 128 extends upwardly from the second hook 124 and is interposed between the flat body 120 and the upturned portion of the second hook 124. This defines a third channel 134 for slidably receiving the lower edge of a printed information card as well as a fourth channel 136 for receiving the other of the upper and lower edges of the associated track end flanges.

What is claimed is:

1. A merchandising device comprising:

first and second elongate parallel tracks arranged side by side with a gap therebetween, each of said tracks being adapted to support a row of articles such that said articles in said row are suspended from said each track for movement along a path defined by said each track and are removable from said each track through a front end of said each track; and a bridging member disposed near said front ends of said tracks and spanning said gap to provide a billboard surface extending between said tracks, wherein said each track comprises a pair of side walls interconnected by a top wall so as to form a channel structure, and an end flange formed at said front end thereof, said end flange of said each track having portions extending outwardly from said side walls of said each track, and said end flanges of said tracks are interconnected by said bridging member.

2. The merchandising device according to claim 1, wherein said bridging member is interposed between and in abutment on said tracks to maintain a predetermined distance between said tracks.

3. The merchandising device according to claim 1, wherein said bridging member is removably mounted on both said tracks.

4. The merchandising device according to claim 1, further comprising support means for supporting said tracks such that said each track is inclined downwardly toward said front end thereof whereby said articles when supported by said each track are allowed to gravity feed toward said front end of said each track along said path.

5. The merchandising device according to claim 1, wherein each of said end flanges has upper and lower edges, and said bridging member is of a one-piece structure formed of resilient material, said bridging member comprising first engaging means for hooking over one of said upper and lower edges of said each end flange, and second engaging means for snap engagement with the other of said upper and lower edges of said each end flange.

6. The merchandising device according to claim 5, wherein said bridging member further comprises a flat body having a front side for providing said billboard surface and a rear side opposite to said front side, said first and second engaging means being formed on said rear side and being positioned in an opposing relationship, said first engaging means comprising a first hook extending from said rear side and being turned toward said second engaging means to envelop said one edge of said each end flange, said second engaging means comprising a second hook extending from said rear side generally toward said first engaging means and curved away from said first engaging means.

7. The merchandising device according to claim 6, wherein said first and second engaging means each extends along a width of said flat body to opposite side edges, at least one of said first and second engaging means being in abutment at said opposite side edges thereof on said tracks to maintain a predetermined distance between said tracks.

8. The merchandising device according to claim 6, wherein said bridging member further comprises upper and lower opposing lipped flanges extending from said front side, said lipped flanges defining channels for slidably receiving upper and lower edges of a printed information card.

9. The merchandising device according to claim 6, wherein said bridging member further comprises first and second partitions extending respectively from said first and second hooks toward each other, said first partition and said flat body defining therebetween a channel for slidably receiving an upper edge of a printed information card, said second partition and said flat body defining therebetween a channel for receiving a lower edge of said printed information card.

10. The merchandising device according to claim 1, further comprising support means for supporting said tracks in a side-by-side disposition, said support means comprising a pair of front and rear transverse support members disposed generally perpendicularly to said tracks, said each track comprising first means for mounting said each track on said front transverse member for movement along said front transverse member, and second means for mounting said each track on said rear transverse member for movement along said rear transverse member, said device further comprising means for preventing said tracks from movement along said transverse members, said preventing means comprising said bridging member.

11. The merchandising device according to claim 10, wherein each of said first and second mounting means of said each track comprises a pair of engaging apertures formed respectively in said side walls of said each track so as to slidably receive a respective one of said front and rear transverse members, and said preventing means further comprises a plurality of recesses formed in each of said transverse members to receive edges of respective ones of said apertures of said each track.

12. A merchandising device comprising:

first and second elongate parallel tracks each including a pair of side walls interconnected by a top wall so as to form a channel structure, and an end flange formed at a front end of said each track, said end flange of said each track having portions extending outwardly from said side walls of said each track, said first and second tracks being arranged side by side with a gap between said end flanges thereof, said each track being adapted to support a row of articles such that said articles in said row are suspended from said each track for movement along a path defined by said each track and are removable from said each track through said front end of said each track; and a bridging member located between said first and second tracks and spanning said gap between said end flanges to provide a billboard surface.

13. The merchandising device according to claim 12, wherein said outwardly extending portions of said end flange are formed respectively along forward edges of said side walls of said each track.

* * * * *